US006832603B2

(12) United States Patent
Knollmayr

(10) Patent No.: US 6,832,603 B2
(45) Date of Patent: Dec. 21, 2004

(54) OIL SEPARATOR FOR A CRANKCASE VENTILATION SYSTEM IN AN INTERNAL COMBUSTION ENGINE

(75) Inventor: Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/683,121

(22) Filed: Oct. 14, 2003

(65) Prior Publication Data

US 2004/0144374 A1 Jul. 29, 2004

(30) Foreign Application Priority Data

Oct. 17, 2002 (AT) ..... 690/2002 U

(51) Int. Cl.[7] ..... F01M 13/04
(52) U.S. Cl. ..... 123/572
(58) Field of Search ..... 123/572–574, 123/41.86

(56) References Cited

U.S. PATENT DOCUMENTS

| | | | | |
|---|---|---|---|---|
| 3,721,069 | A | 3/1973 | Walker | |
| 5,450,835 | A | 9/1995 | Wagner | |
| 5,460,147 | A | 10/1995 | Bohl | |
| 6,024,058 | A | 2/2000 | Burnett | |
| 6,279,556 | B1 * | 8/2001 | Busen et al. | 123/572 |
| 6,591,820 | B2 * | 7/2003 | Kitano et al. | 123/572 |
| 6,626,163 | B1 * | 9/2003 | Busen et al. | 123/572 |
| 6,694,957 | B2 * | 2/2004 | Schueler et al. | 123/572 |

FOREIGN PATENT DOCUMENTS

| | | |
|---|---|---|
| DE | 3107191 | 6/1982 |
| DE | 19642218 | 4/1998 |
| DE | 19715061 | 10/1998 |
| FR | 2332424 | 6/1977 |

* cited by examiner

*Primary Examiner*—Marguerite McMahon
(74) *Attorney, Agent, or Firm*—Dykema Gossett PLLC

(57) ABSTRACT

An oil separator for a crankcase ventilation system in an internal combustion engine having a housing including an inlet and an outlet for a ventilation tube and an oil return line fitting, an enlarged cross section formed by a diffuser being provided in the flow path between inlet and outlet and the oil return line fitting being disposed in the region of the largest cross section of the diffuser and at the lowest point of the housing, includes a substantially tubular entrance part disposed in the region of the outlet and projecting inside the housing, preferably in the region of the largest cross section of the diffuser, and the flow cross section is smaller than the largest cross section of the diffuser, and the flow cross section is smaller than the largest cross section of the diffuser and inlet, outlet, diffuser and/or entrance part are disposed about the same axis.

9 Claims, 1 Drawing Sheet

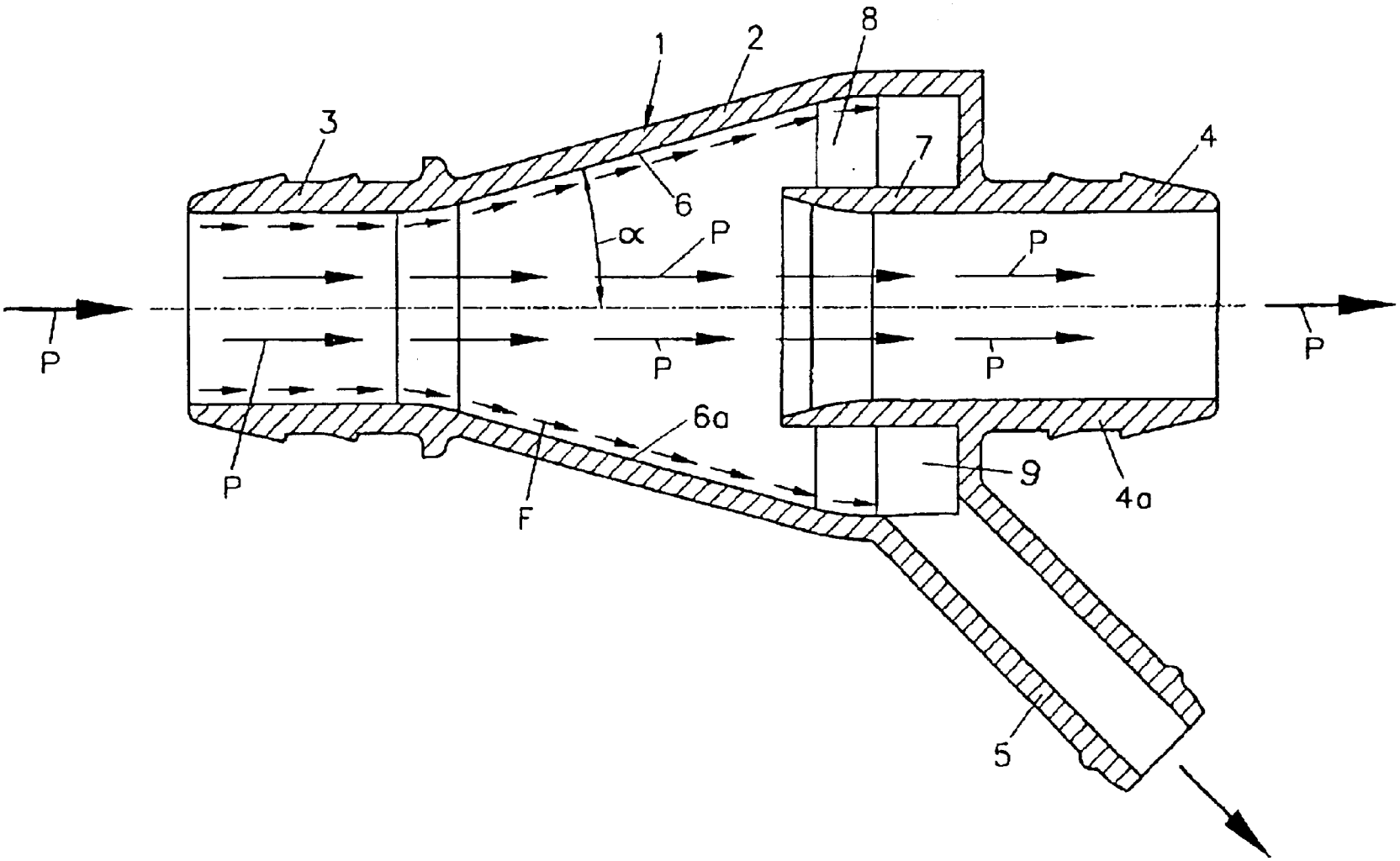
P
P
P
P
P
P
P
1
2
3
4
4a
5
6
6a
7
8
9
α
F

OIL SEPARATOR FOR A CRANKCASE VENTILATION SYSTEM IN AN INTERNAL COMBUSTION ENGINE

BACKGROUND OF THE INVENTION

The invention relates to an oil separator for a crankcase ventilation system in an internal combustion engine having a housing comprised of an inlet and an outlet for a ventilation tube and of an oil return line fitting, an enlarged cross section formed by a diffuser being provided in the flow path between inlet and outlet and the oil return line fitting being disposed in the region of the largest cross section of the diffuser and at the lowest point of the housing.

DESCRIPTION OF PRIOR ART

An oil separator for a crankcase ventilation system is known from U.S. Pat. No. 6,024,058, said oil separator consisting of one approximately vertically arranged inlet tube and of one outlet tube connected in branching relation thereto. The inlet tube discharges into an oil reservoir from which an oil return line takes departure. Said oil separator is quite bulky and only suitable for vertical mounting. At higher flow rates, the warranty on sufficient oil separation is voided.

U.S. Pat. No. 3,721,069 describes an oil separator in an internal combustion engine that consists of a housing having an inlet and an outlet for a ventilation tube and of an oil return line fitting provided in the bottom region thereof. The tubular outlet connector is disposed in the center of the housing bottom region and extends into a filter chamber provided within said housing. The air-oil mixture coming from the crankcase flows through several filter layers before leaving the oil separator. The filter layers promote separation of the oil. Again, this oil separator is only suited for vertical mounting and comprises a great number of component parts.

An oil separator which is integrated in a cylinder head cover and is comprised of baffles formed by ridges is known from DE 197 15 061. The oil separator has an incline between inlet and oil outlet. The oil outlet includes a small oil drain tube that plunges into an oil chamber formed by weirs integrally formed therewith.

DE 196 42 218 A1 shows an oil separating device having an oil separating element which is comprised of a first and of a second electrode that are each connected to a respective high voltage power source, both being disposed in the flow path of the oil-gas mixture and having different polarities. Oil separation thereby relies on the electrostatic principle.

DE 31 07 191 A1 discloses a crankcase ventilation for a piston engine having a funnel-shaped fluid separator with a separator seal and a strainer that is directed upward and forms a sump for the separated fluid. The lowest point of the sump is the site from which a fluid drain tube, which is disposed within the ventilation tube and extends into the crankcase, takes departure.

The document FR 23 32 424 A describes an oil separating device in a supercharged diesel combustion engine having a double conical housing in the center of which there is disposed a heat exchanger. A plurality of deflectors is disposed across the flow direction to separate oil from the air flow. An oil drain tube is provided for at the lowest point thereof.

Oil separators for crankcase ventilation systems that rely for operation on a cyclone action are further known. Such type oil separators are described in U.S. patent application 2002/0088445 A1, U.S. Pat. No. 6,279,556 B1, U.S. Pat. No. 5,460,147 or in U.S. Pat. No. 5,450,835.

At higher flow rates in particular, prior art devices can no longer ensure sufficient oil separation to take place.

SUMMARY OF THE INVENTION

It is the object of the invention to avoid these disadvantages and to achieve simplest reliable oil separation while occupying as little space as possible, more specifically at higher flow rates.

This is achieved in accordance with the invention in that there is disposed, in the region of the outlet, a substantially tubular entrance part that projects inside the housing, preferably in the region of the largest cross section of the diffuser, and that the flow cross section is smaller than the largest cross section of the diffuser and that inlet, outlet, diffuser and/or entrance part are disposed about the same axis. The diffuser disposed behind the inlet and the entrance part projecting inside the housing permit to separate even larger quantities of oil without any further inserts such as deflectors or the like being needed. Secure oil separation is more specifically achieved by configuring the oil separator to be a primary oil separator which may be mounted upstream of a main oil separator in the crankcase ventilation system.

There is preferably provided that the entrance part variably reduces the flow cross section.

Particularly high oil separation rates can be achieved if an annular sump is formed between housing and entrance part.

A very compact implementation of the oil separator can be achieved when inlet, outlet, diffuser and/or entrance part are configured to be rotationally symmetrical with inlet, outlet, diffuser and/or entrance part being preferably disposed about the same axis.

The oil separator is suited for both horizontal and vertical installation and can be easily integrated into existing crankcase ventilation systems.

Particularly good results are achievable when the diffuser is angled relative to the longitudinal axis at an aperture angle of 30° maximum, preferably at an angle comprised between 10° and 20°.

BRIEF DESCRIPTION OF THE DRAWINGS

The invention will be described in greater detail hereinafter with reference to the FIGURE.

The FIGURE is a longitudinal section of an oil separator 1 in accordance with the invention.

DETAILED DESCRIPTION OF THE PREFERRED EMBODIMENT

The oil separator 1 comprises a housing 2 with an inlet 3 and an outlet 4 for the ventilation tube (not shown) of a crankcase ventilation system. At the lowest point of the housing 2 there is disposed an oil return line fitting 5. Between inlet 3 and outlet 4, housing 2 is configured as a diffuser 6 opening in the direction of flow P. The aperture angle $\alpha$ formed between diffuser 6 and the longitudinal axis 7 of housing 2 is comprised between about 5° and 30°, and is of approximately 15° in the embodiment.

The outlet connector 4*a* of outlet 4 is comprised of a tubular entrance part 7 that projects inside the housing 2 and is disposed approximately in the region 8 of the largest cross section of the diffuser 6. Between entrance part 7 and housing 2, an annular oil sump 9 is formed. The oil return line fitting 5 is disposed at the lowest point of sump 9.

As indicated by the arrows P, the crankcase ventilation flow enters the diffuser 6 through inlet 3 and exits the same through outlet 4. The pressure drop resulting from the diffuser 6 causes oil droplets to deposit on the walls 6*a* of diffuser 6, thus forming an oil film on the wall thereof as indicated by the arrows F. The oil accumulates at the lowest point of housing 2 and exits said housing 2 through the oil return line fitting 5 to return into the lubrication circuit of the internal combustion engine.

The oil separator 1 is best suited for use as a primary oil separator for a crankcase ventilation system in order to achieve reliable oil separation at higher flow rates. This primary oil separator permits to reliably separate from the gas flow an entrained oil film deposited on a wall prior to entering a suited main separator.

What is claimed is:

1. An oil separator for a crankcase ventilation system in an internal combustion engine having a housing comprised of an inlet and an outlet for ventilation tube and of an oil return line fitting, an enlarged cross section formed by a diffuser being provided in a flow path between inlet and outlet and the oil return line fitting being disposed in a region of a largest cross section of the diffuser and at a lowest point of the housing, wherein there is disposed, in a region of an outlet, a substantially tubular entrance part that projects inside the housing and wherein a flow cross section is smaller than a largest cross section of the diffuser and that inlet, outlet, diffuser and/or entrance part are disposed about the same axis.

2. The oil separator according to claim 1, wherein the tubular entrance part projects inside the housing in a region of the largest cross section of the diffuser.

3. The oil separator according to claim 1, wherein inlet, outlet, diffuser and/or entrance part are configured to be rotationally symmetrical.

4. The oil separator according to claim 1, wherein the entrance part variably reduces the flow cross section.

5. The oil separator according to claim 1, wherein an annular sump is formed between housing and entrance part.

6. The oil separator according to claim 1, wherein the diffuser is angled relative to a longitudinal axis of the housing at an aperture angle of $>0$ and $\leqq 30°$.

7. The oil separator according to claim 6, wherein the aperture angle is comprised between 10° and 20°.

8. The oil separator according to claim 1, wherein the oil separator is suited for both horizontal and vertical installation.

9. The oil separator according to claim 1, wherein said oil separator is configured to be a primary oil separator which is mountable upstream of a main oil separator in a crankcase ventilation system.

* * * * *